US005333634A

United States Patent [19]

Taylor

[11] Patent Number: 5,333,634

[45] Date of Patent: Aug. 2, 1994

[54] INVERSE UMBRELLA TENT

[76] Inventor: Delbert Taylor, 395 S. 600 East, Salt Lake City, Utah 84102

[21] Appl. No.: 969,063

[22] Filed: Oct. 30, 1992

[51] Int. Cl.[5] ..... E04H 15/28

[52] U.S. Cl. ..... 135/98; 135/104; 135/118; 135/119

[58] Field of Search ..... 135/98, 104, 102, 28–32, 135/118, 119; 24/136 K, 136 L, 563, 311; 16/93 R, 93 D

[56] References Cited

U.S. PATENT DOCUMENTS

| | | | |
|---|---|---|---|
| 634,018 | 10/1899 | McGee | 135/30 |
| 645,704 | 3/1900 | Downs | 135/98 |
| 752,178 | 2/1904 | Peate | 135/28 |
| 769,887 | 9/1904 | Serge-Kisslow | 135/28 |
| 883,503 | 3/1908 | Warfel | 135/28 X |
| 904,349 | 11/1908 | Moulton | 135/30 |
| 985,842 | 3/1911 | Roney | 135/28 |
| 998,462 | 7/1911 | Burch | 135/98 |
| 2,604,898 | 7/1952 | Suel et al. | 135/30 |
| 2,864,389 | 12/1958 | Smith et al. | 135/98 |
| 3,157,186 | 11/1964 | Hammer | 135/30 |
| 3,177,882 | 4/1965 | Militano | 135/28 X |
| 3,223,098 | 12/1965 | Dole | 135/104 |
| 3,794,054 | 2/1974 | Watts . | |
| 4,193,413 | 3/1980 | Watts et al. | 135/98 |
| 4,201,237 | 5/1980 | Watts et al. | 135/98 |
| 4,236,543 | 12/1980 | Moss | 135/104 X |
| 4,352,362 | 10/1982 | Nichols | 135/98 |
| 5,197,504 | 3/1993 | Howe | 135/119 X |

*Primary Examiner*—Carl D. Friedman
*Assistant Examiner*—Robert J. Canfield
*Attorney, Agent, or Firm*—M. Reid Russell

[57] ABSTRACT

A collapsible shelter or tent commonly known as an umbrella tent, that includes an integral frame and cover, the frame including tent poles formed of interconnected tent pole sections whose ends are telescoped together and are urged in their telescoped coupling by an elastic cord that is maintained, under tension, within each tent pole. Each tent pole is pivotally connected at a top end to extend radially from a crown, with the opposite tent pole end maintained to a web strap that extends from a base of which cover, with a number of slides mounted to slide along each tent pole that individually connect to and extend from loops secured at vertical intervals to extend outwardly from which cover. Both the crown and an erecting ring each receive a center pole fitted to slide axially therethrough, and the erecting ring pivotally mounts a rib end thereto that pivotally couples at its opposite end to the tent pole at an intermediate point therealong. When the crown and erecting ring are slid together along the center pole, each rib pivots outwardly urging the connected tent pole into a bowed attitude, providing an umbrella type opening of the shelter, that can then be collapsed by pulling the erecting ring away from which crown slide, collapsing the frame. Whereafter the individual tent poles can be disconnected by pulling them apart and folding them together into a bundle for rolling in the tent material.

21 Claims, 6 Drawing Sheets

INVERSE UMBRELLA TENT

BACKGROUND OF THE INVENTION

1. Field of the Invention

This invention relates to portable collapsible tent type shelters and more particularly to umbrella type tents that do not require a central support pole.

2. Prior Art

Tent type structures involving flexible material formed into a cover and supported over a rigid frame have, of course, long been in use as portable tent type structures. In recent times, separately erected frame structures that receive, after erection, a flexible material formed into a cover and fitted and secured thereover have been replaced by integral tent frame and covering arrangements. One such arrangement is an umbrella tent that comprises a tent covering that is mounted to a center tent pole and is held in an extended attitude by poles that are pivoted outwardly from pivot points that are at or near the top of the center pole. With such tents, the center tent pole has the disadvantage of reducing the useable floor area within the erected tent, and the erection of such tent has generally required an appreciable amount of time.

Recently, a number of single unit tent arrangements have been developed that are more readily erected and collapsed, and including tent poles formed from telescoping sections for arrangement in sleeves that are formed in the tent material itself. Nevertheless such tents have required a considerable amount of time for assembling the tent poles and the erection of the tent. A single unit umbrella tent by Watts, U.S. Pat. No. 3,794,054, is an attempt to incorporate the advantages of an umbrella tent without the hindrance of a ground engaging center pole. The Watts tent also includes telescoping tent poles that extend from around a pole hub. The tent unit of the Watts patent is further capable of being broken down by disconnecting the individual poles into sections to form a small compact bundle for transport and is conveniently erectable as a unit at a site. The Watts tent, however, suffers from a number of deficiencies that the present invention improves upon including: a failure of the tent poles and rib of the Watts tent to regularly travel in a straight vertical line during tent erection often resulting in a collapse of tent poles toward one another during their outward bowing; a failure of tent material loops to slide properly along the tent poles during erection, causing tent material bunching and tearing; and a failure to reliably mount tent pole foot ends to the tent bottom, resulting in the bowed tent pole foot end tearing away from the tent material bottom portion. Like the Watts tent, the present invention employs a short inverted center pole or erecting rod that extends upwardly from the tent apex and is arranged to slide in a pole hub or crown sleeve to a top end of which rod, the hub or crown pivotally connecting to tent poles. The pivot connection of the tent poles of the invention, however, is a ball with shoulders or a cylinder with seat arrangement that stabilizes the tent pole path of travel to an extended attitude. Also distinct to the invention is a clevis type pivot coupling for joining each rib end to a point along a tent pole, the clevis type coupling for preventing a canting of the rib to the tent pole during erection. The unique pivot coupling and clevis connection of the invention prohibiting tent frame collapse that is prevalent utilizing the tent of the Watts patent. Further unique to the invention over the Watts tent are tent covering material pole slide arrangements that are each for mounting to a loop that extends from spaced point along the surface of the tent material, aligning with a tent pole the individual slides of the invention are arranged to slide freely along a tent pole during tent erection to allow the tent covering material to reposition itself as it is stretch from a loose to taut state across the tent frame. The above features along with an improved arrangement of collapsing tent poles and their mounts to web strap extensions from the tent floor provide an improved inverse umbrella tent of the invention that is both easy to erect and can be easily broken down to a compact bundle for storage and transport.

SUMMARY OF THE INVENTION

It is a principal object of the present invention in an improved inverse umbrella tent to provide a tent having poles and tent material arranged as a unit that can be both quickly and easily erected and conveniently broken down to a small bundle for transport and storage.

Another object of the present invention is to provide a short inverse center pole arrangement as the tent apex that is axially fitted to slide through a tent pole hub or crown that is pivotally coupled to tent poles, and an erecting ring that pivotally mounts to ribs, the center pole for guiding erecting ring upward travel engage the crown to extend outwardly ribs that are urged outwardly bending connected tent poles into a bowed state, erecting the umbrella tent frame.

Another object of the present invention is to provide an efficient and reliable rib and tent pole pivot coupling arrangement for preventing deviation from a vertical path of travel of each rib and connected tent pole as the erecting ring is urged upwardly towards the crown for erecting the tent frame and stretching the tent covering material thereacross.

Another object of the present invention is to provide, as the pivot coupling ends of each rib to the erecting ring and tent pole end to the tent pole hub or crown, either a sphere with shoulders or cylindrical pivot as the rib and tent pole ends which pivot is maintained in a seat that is formed in the respective erecting ring and hub or crown.

Another object of the present invention is to provide, as the pivot coupling of the rib end opposite to its spherical or cylinder coupling, a clevis type pivot coupling connected to an inter-medial point along each tent pole.

Still another object of the present invention is to provide as individual tent poles of the tent of the invention tent pole sections that are arranged to be telescoped together into a straight hollow pole, with each straight pole containing an elastic cord that is fitted under tension through the connected tent pole sections, and is to urge which pole sections together, the elastic force of which cord to be overcome by pulling pole sections apart and folding them together for rolling within the tent covering material, forming a compact bundle of the tent covering material and pole sections for transport.

Still another object of the present invention is to provide a reliable slide arrangement, each for mounting to a tent material loop or strap, the slides for individually receiving to travel freely along a tent pole as the tent frame is erected and taken down, the slides avoiding binding of the tent covering material to the tent poles as the tent material is stretched during opening.

Still another object of the present invention is to provide web straps as tent floor extensions, each for receiving and coupling to a tent pole foot end and for receiving a tent stake fitted therethrough that is driven into the ground, for anchoring the tent floor.

The above objectives are achieved by the present invention that provides an improved inverse umbrella tent. Specifically, while the tent of the invention is arranged to be erected in a manner similar to opening an umbrella, it involves a sliding rather than a stationary center pole that is axially fitted through slides. The sliding center pole of the invention is for guiding travel of an erecting ring that is moved axially on which center rod or pole towards a hub or crown, which movement outwardly extends tent pole and ribs, and the tent pole bowed outwardly to form an erected tent frame. The center pole can be slid upwardly or downwardly through the erecting ring and crown between end stops.

Supported on the center pole the erecting ring is moved upwardly towards the crown to erect the tent frame, which travel pivots ribs that extend radially from around the erecting outwardly, which ribs each pivotally connect on their opposite end to the tent poles at intermediate points therealong. The ribs outward travel urges the tent poles outwardly into a bowed attitude. Which tent poles are pivotally connected at their upper ends, respectively, to the crown that is the tent frame apex. Covering material for the tent is cut and sewn so as to fit tightly over the erected tent frame and includes a number of spaced vertical columns of loops extending therefrom that align with the individual bowed tent poles. Each loop is to receive a slide of the invention fitted thereto. The slides are to travel along the tent poles and where through a tent pole is fitted in sliding arrangement that provides for tent material positioning along the tent poles during frame erection, allowing the tent material to be fully stretched across the tent poles.

Unique features of the inverted umbrella tent of the invention include embodiments of ball and cylinder pivot couplings of the tent pole and rib ends radially to seats formed in the crown and the erecting ring. Further, the ribs opposite ends to their ball or cylinder pivot ends are each connected to an intermediate point along a tent pole utilizing a clevis type pivot coupling. The combination of the tent pole and rib ball and cylindrical pivot mountings and each rib clevis coupling to the tent pole at an intermediate point therealong, provides for controlling rib extension and tent pole bowing to where the tent poles and ribs each travel to a straight vertical path of travel along a radial from the crown and erecting ring as the tent frame is erected. Also, unique to the invention is a slide arrangement for mounting the tent covering material for stretching across the erected tent poles. Each slide is arranged to travel along a tent pole fitted through an eyelet portion thereof such that, as the tent is ballooned outwardly with the tent pole bowing into the erected tent frame, the slides that are individually connected to tent covering material loops and travel freely along the tent poles allowing the tent material to fully balloon outwardly to an open attitude without binding at points along the bowed tent poles. The invention provides two embodiments of slides one of which includes a pair of parallel yokes that are interconnected at their ends by parallel bars that are passed through tent material loops that extend for the tent material outer surface with the tent pole fitted through opening in which aligned yokes. The other slide embodiment involves a round ring arranged for fitting to slide along which tent pole and includes an outwardly extending key portion that is for turning into a slot that is formed in a side of a rectangular ring wherethrough a tent covering material loop is fitted. Additionally, the tent pole foot ends are connected to web straps that align with the tent material loops and extend outwardly from a tent floor. Whereby, as the tent poles are bowed outwardly, as set out above, the tent pole foot ends are also spread apart, stretching, in turn, the tent floor between which tent pole feet. Which web straps further include holes formed therethrough for receiving tent stakes driven into the ground to anchor the tent.

Additional objects and features of the invention will become apparent from the following detailed description taken together with the accompanying drawings.

BRIEF DESCRIPTION OF THE DRAWINGS

A preferred embodiment of the improved inverse umbrella tent of the invention that represents a best mode as is presently contemplated for carrying out the invention is illustrated in the accompanying drawings, in which.

DETAILED DESCRIPTION

Figure 1:
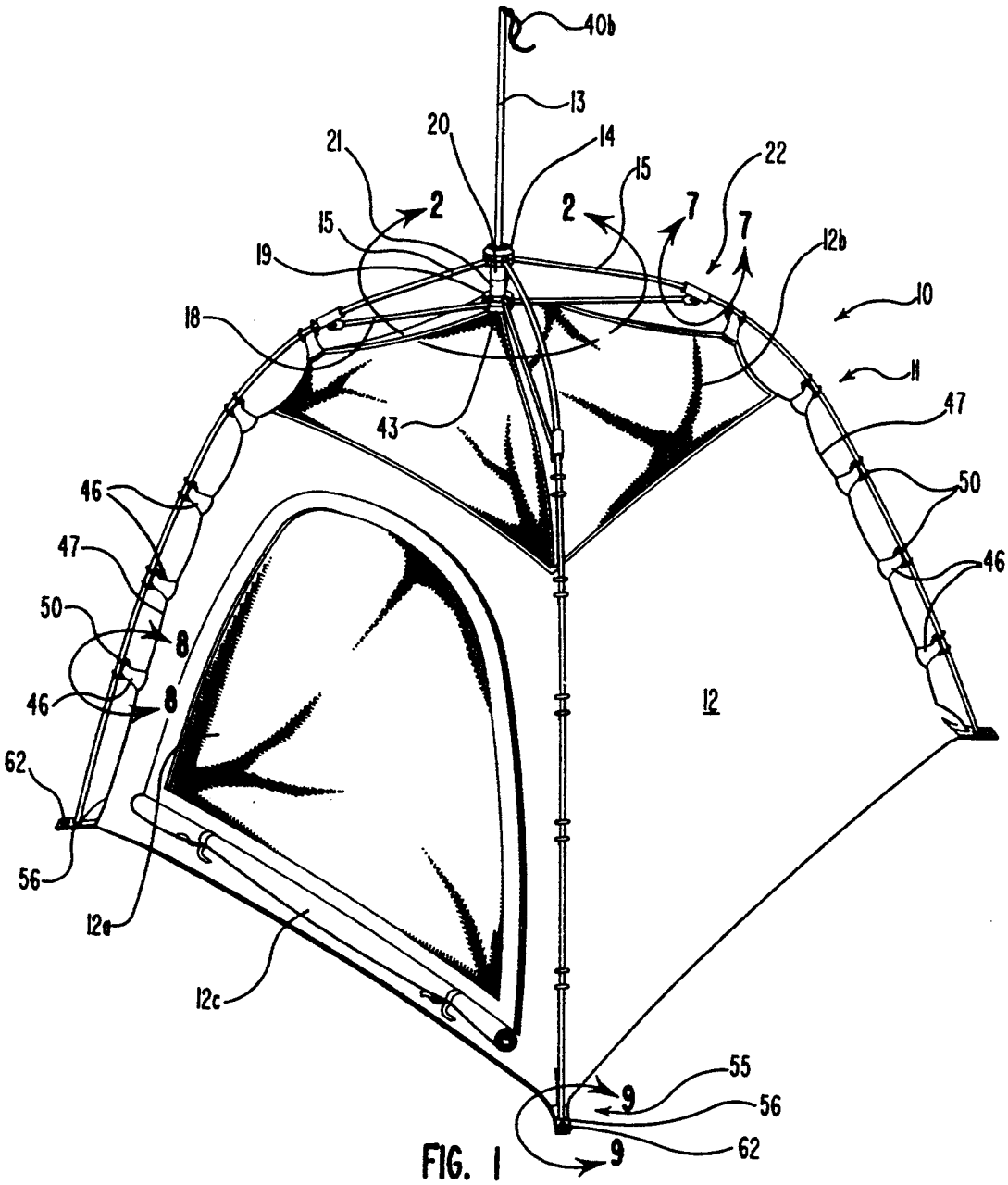
FIG. 1 is a side elevation perspective view of an erected inverse umbrella tent of the invention.
Figure 2:
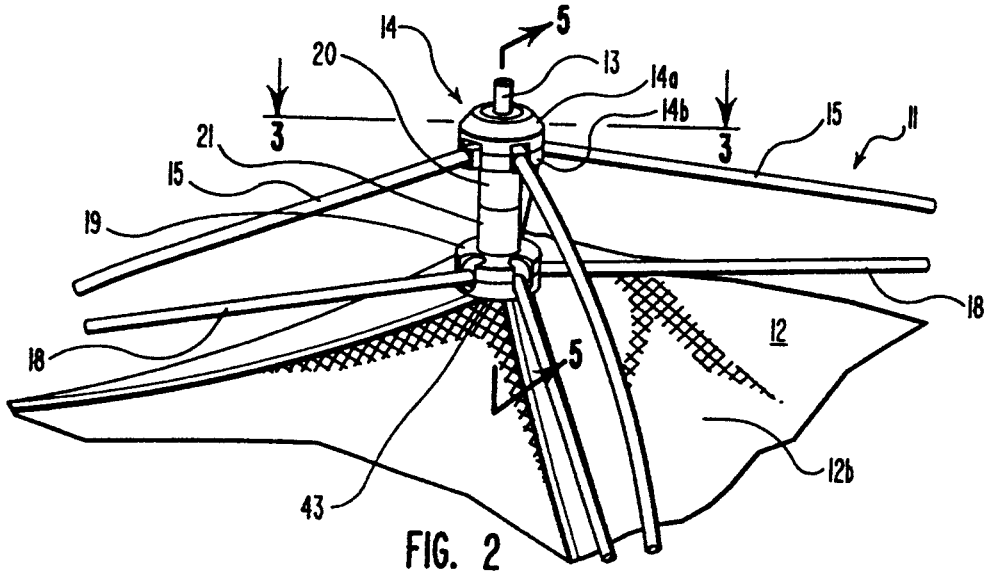
FIG. 2 is a top plan sectional view taken within the line 2—2 of FIG. 1.

FIG. 1 shows a preferred embodiment of an improved inverse umbrella tent 10 of the invention hereinafter referred to as tent. The tent 10 is shown erected with a frame 11 supporting a section of tent material 12 that has been cut and sewn into, essentially, a bell or flattened pyramid shape. A center pole 13 is shown extending upwardly from the tent apex that is fitted axially to slid freely through a hub or crown 14, hereinafter referred to as crown. The crown 14 is arranged across the frame 11 apex and supports tent poles 15 that extend radially at intervals. Shown best in FIGS. 3 and 4, the tent pole to crown coupling is a pivot coupling, the tent pole 15 end shown mounting a pivot 16 fitted into a seat 17 that is formed in the crown 14. Two embodiments of pivot couplings of the tent pole 15 end to the crown 14 will be described in detail hereinbelow, and, it should be understood, that the pivot couplings are also preferably utilized as pivot coupling for pivot mounting a rib 18 to an erecting ring 19.

Figure 4:
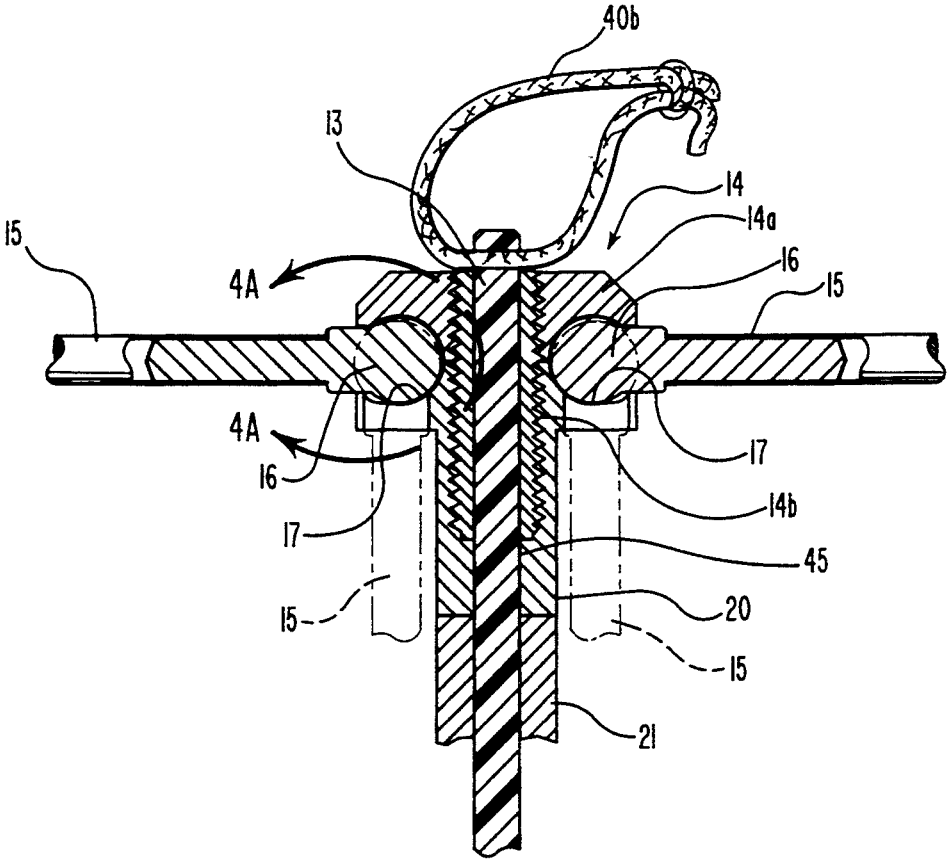
FIG. 4 is a side elevation sectional view taken along the line 4—4 of FIG. 3 showing a sectional view the hub or crown with cylindrical pivots as the pivot coupling secured to the tent pole ends.

Shown best in FIG. 4, the crown 14 includes an upper sleeve 20 that extends axially from its undersurface wherethrough the center pole 13 is fitted to slide. An end of a lower sleeve 21 that extends axially from the upper surface of the erecting ring 19 and wherethrough center pole 13 is fitted axially is shown in connecting the opposite end of the upper sleeve 20. Moving the respective upper and lower sleeves 20 and 21 into engagement provides for erecting the frame 11, with, in such erection, the tent poles 15 is urged by the outward travel of ribs 18 into the bowed attitude shown in FIG. 1, which ribs are each individually pivotally connected to a tent pole 15 by a clevis type coupling 22, as shown best in FIG. 7. In which bowed attitude the tent material 12 that is supported to frame 11 is stretched across the erected frame 11 into erected tent 10. To provide tent pole 15 bowing, the movement of the erecting ring 19 towards the crown 14 provides for pivoting the ribs 18 upwardly to an outwardly extended attitude, urging the tent poles 15 to a bowed attitude, as shown in FIG. 1.

Figure 7:
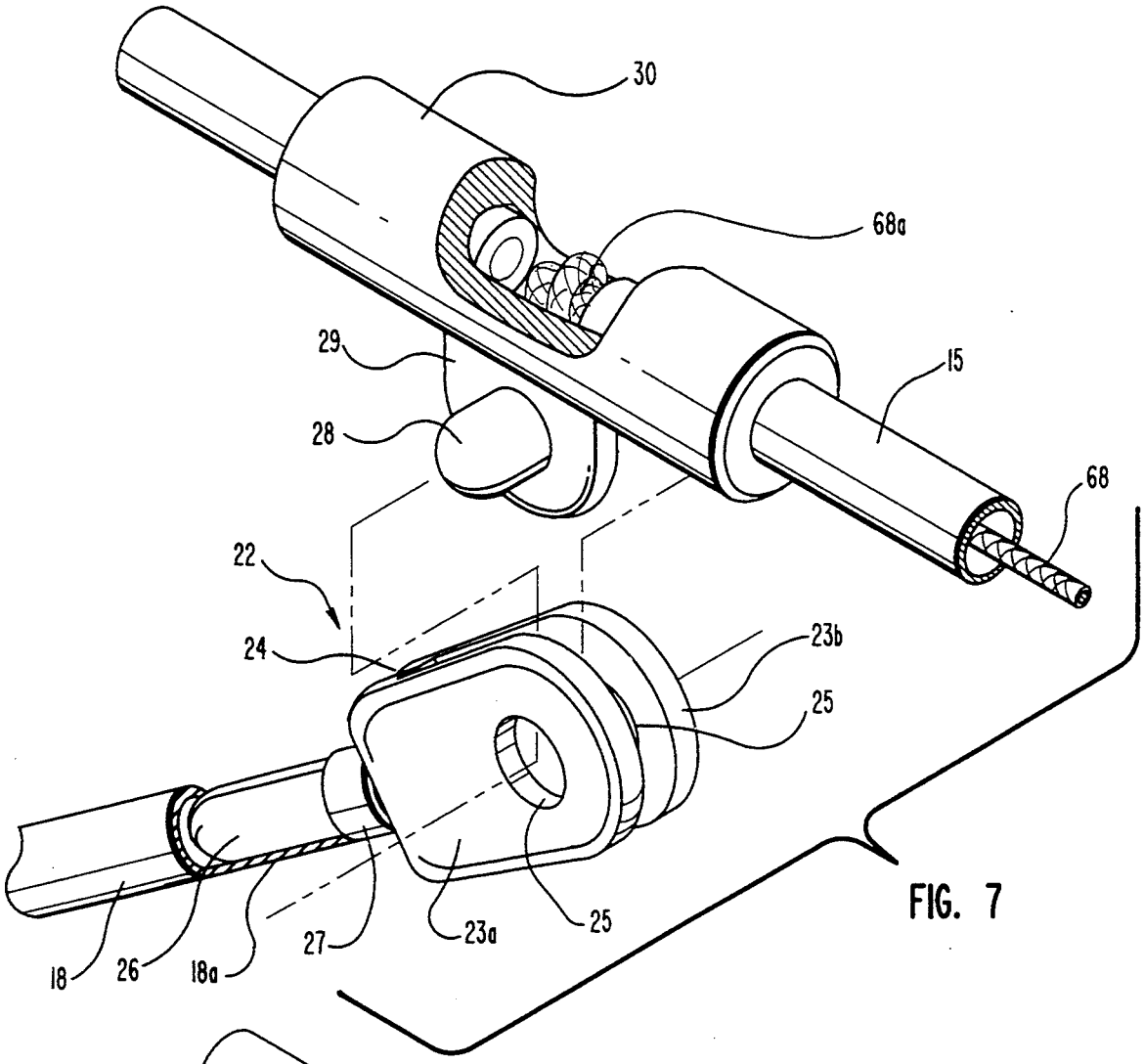
FIG. 7 is an exploded and expanded side elevation view taken within the line 7—7 of FIG. 1, showing a clevis type coupling that connects a rib end to a tent pole at an intermediate point along a tent pole.

The clevis type coupling 22, shown in FIG. 7, includes a yoke that includes opposing parallel plates 23*a* and 23*b* extending from a ends of a web 24. The plates 23*a* and 23*b* each include a hole 25 formed through each that are aligned, and a tongue 26 is secured at a right angle to the web 24 undersurface, extending oppositely to which parallel plates. The tongue 26 is for fitting into an open end 18*a* of rib 18 and is maintained therein by a collar 27 that can be threaded and turned over a threaded rib end. Or, the collar can be fitted over which rib end and struck at intervals therearound as with a braiding tool or like sharp pointed instrument, for coupling the collar to which rib end, thereby securing the tongue therein. For providing the pivot coupling, the aligned holes 25 formed through the clevis plates 23*a* and 23*b* receive a pin 28 that is maintained through a center plate 29 that extends at a right angle from the side of a tent pole sleeve 30, in alignment with the sleeve longitudinal axis. The pin 28 is shown as having rounded ends for facilitating passage of which ends into plate holes 25. Which pin passage can involve flexing the clevis plates 23*a* and 23*b* apart, or the pin 28 can be fitted through the aligned clevis plate holes 25 and through the center plate 29 for seating as a pivot. The sleeve 30 wherefrom the center plate 29 extends is fitted to the tent pole 15. So arranged, an outward extension of rib 18 provides for an outward extension and bowing of the connected tent pole 15, the clevis coupling 22 controlling the path of travel or track of which tent pole 15 to retain it along a radial from which crown 14, precluding a canting to one side of that radial as could result in tent frame 11 collapse. As set out hereinbelow, the combination of the pivot end couplings of the tent poles 15 and ribs 18 in the crown 14 and erecting ring 19 along with the clevis pivot coupling 22 of each rib to a tent pole 15 insures that the individual tent pole 15 and connected rib 18 will follow a straight vertical path of travel outwardly as the tent frame 11 is erected, maintaining the tent poles in their space attitude as they are bowed outwardly.

Figure 5:
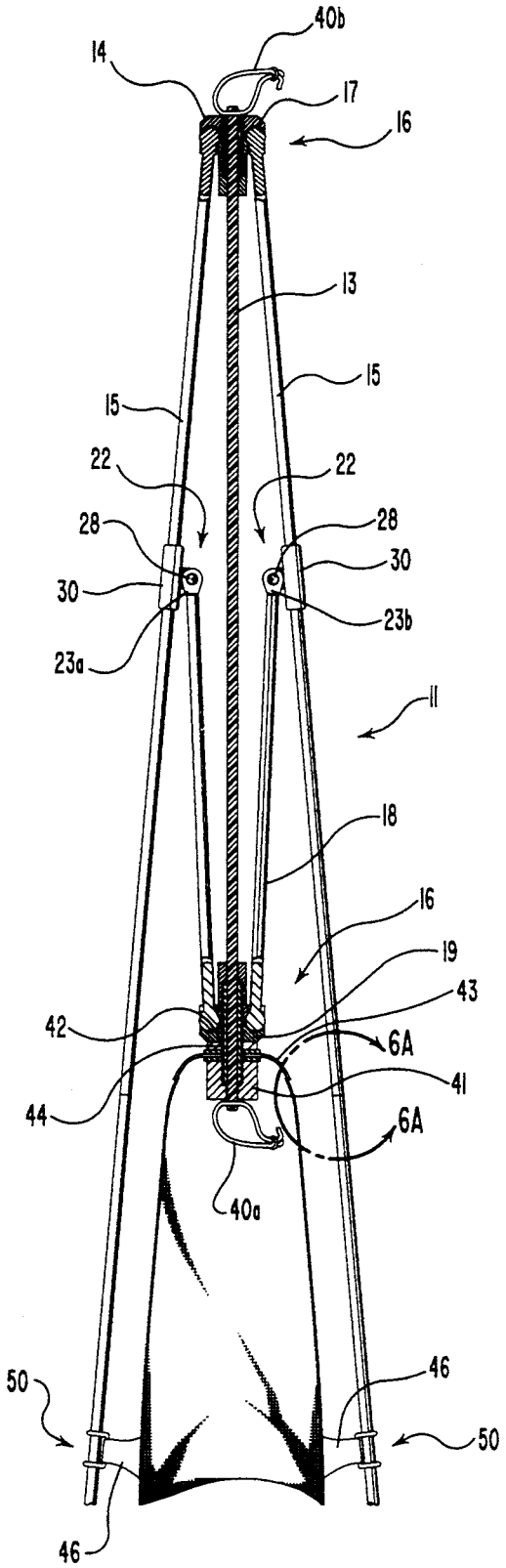
FIG. 5 is a side elevation sectional view taken along the line 5—5 of FIG. 2, showing the top portion of the tent frame of the invention collapsed with a tent material cover shown suspended from which frame.

The invention, as set out above, includes a unique pivot structure for maintaining a straight vertical path of travel of the tent pole 15 and pivotally connected rib 18. Which pivot coupling 16, in one embodiment, shown in FIG. 3A, is a spherical ball 31 that includes shoulders 32 arranged on opposite sides of the end of tent pole 15. The shoulders 32 are rectangular sections with opposite parallel sides and are arranged on opposite sides of the tent pole end, which shoulders 32 parallel sides are at right angles to the undersurface of the crown 14. The crown 14 formed in upper and lower sections, 14*a* and 14*b*, respectively, that are sandwiched together, as shown, includes a seat 33 for each spherical ball 31 and shoulders 32. Both the crown 14 and erecting ring 19 provide seats for the pivot couplings 16 and so a description of the crown seat 33 should be taken as a description of the erecting ring seats, except of course, the erecting ring seat allows for upward vertical travel of the pivotally connected rib 18. The crown upper section 14*a* includes a half spherical seat 34 and is radially slotted at 35 from that seat to the crown outer surface. The slot 35 is for accommodating and guiding the pivot coupling 16 shoulders 32 sliding therealong, with the crown lower section 14*b* also including a mirror image spherical seat 34 and slot 35 for accommodating passage of shoulders 32 therealong. Which slot 35, to allow for tent pole 15 rotation from an outwardly extended attitude to a lowered attitude, as shown in FIG. 5, is formed through approximately ninety (90) degrees of arc. So arranged, the pivot coupling 16 spherical ball 31 with shoulders 32 embodiment is maintained to pivot in seat 34 provides for and guides tent pole 15 pivoting from a lowered attitude, as shown in FIG. 5, to an erected, outwardly extending, attitude, as shown in FIGS. 1-4. In which travel, the shoulders 32 travel along the crown slots 35 and are guided thereby to maintain a vertical path of travel, prohibiting canting to one side or the other, of the individual tent poles as they are erected. The pivot coupling 16, as described above with respect to crown 14 is preferably utilized for pivotally mounting each rib 18 to the erecting ring 19. With the slots 35 arranged for allowing the ribs 18 to travel from the attitude shown in FIG. 5 to an erected attitude, shown in FIGS. 1–4, formed in a ninety (90) degree arc in the erecting ring lower section. Both the erecting ring upper and lower sections including half spherical seats 34 wherein the spherical ball 31, with shoulders 32 maintained to travel along slot 35, guiding vertical outward travel of which rib 18 to along a radial from which erecting ring 19.

Figure 3:
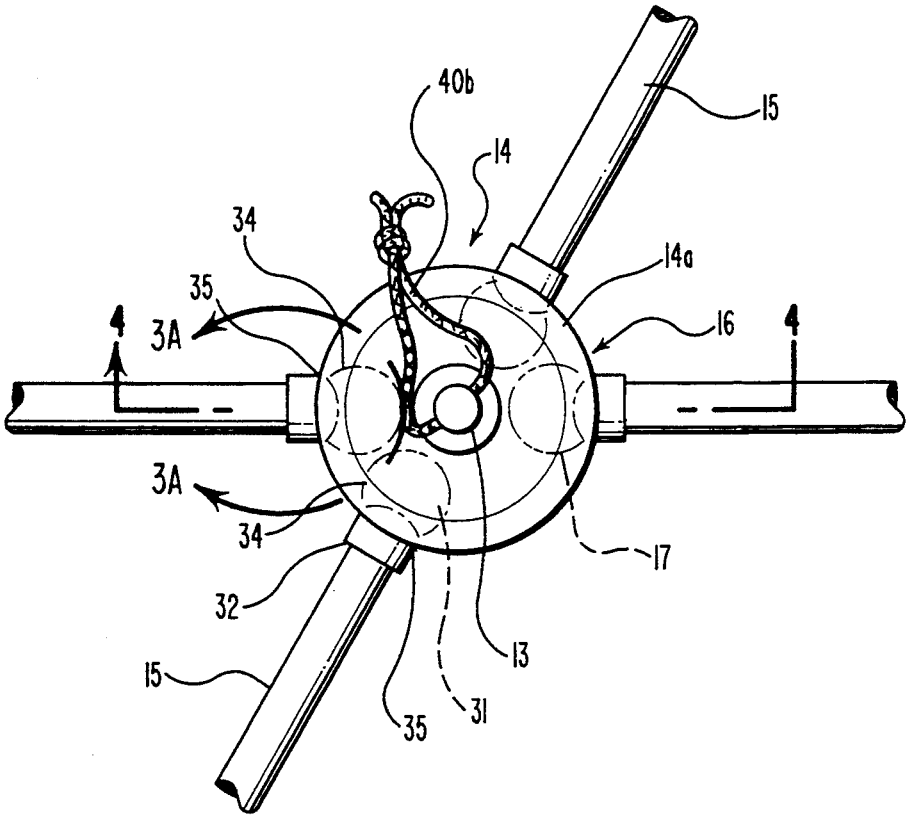
FIG. 3 is an enlarged top plan view taken along the line 3—3 of FIG. 2 showing a hub or crown fitted axially across a top end of an inverse center pole and showing, as pivot mounts, ball ends of tent poles in broken lines mounted in seats formed radially around the hub or crown as a pivot coupling embodiment.
Figure 3A:
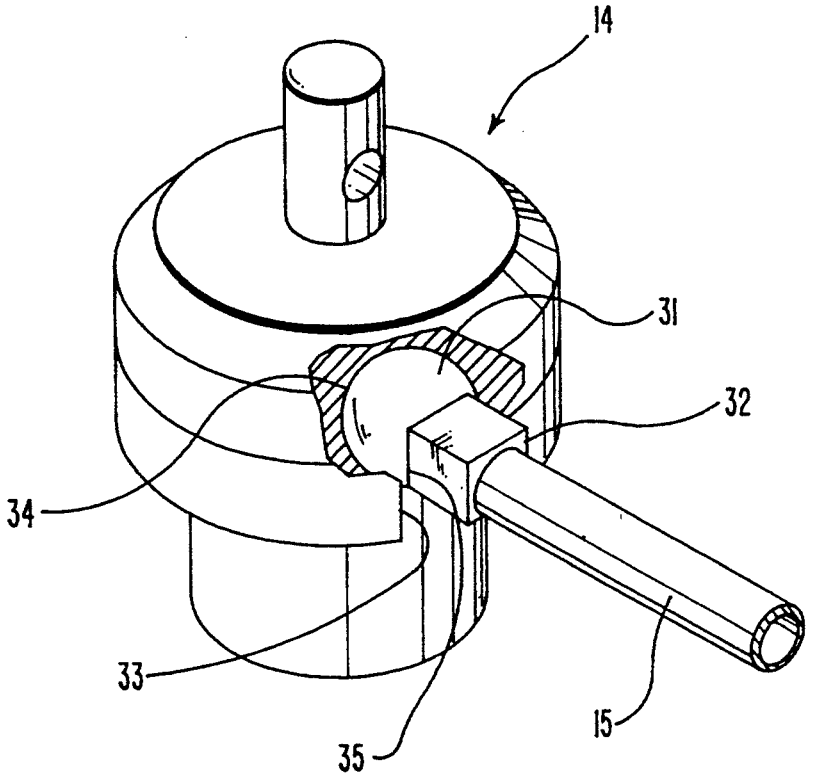
FIG. 3A is an expanded side elevation sectional view taken within the line 3A—3A of FIG. 3, showing each pivot mount ball with shoulder secured across a tent pole end as a ball pivot coupling embodiment mounted in a crown seat that is shown broken away.
Figure 4A:
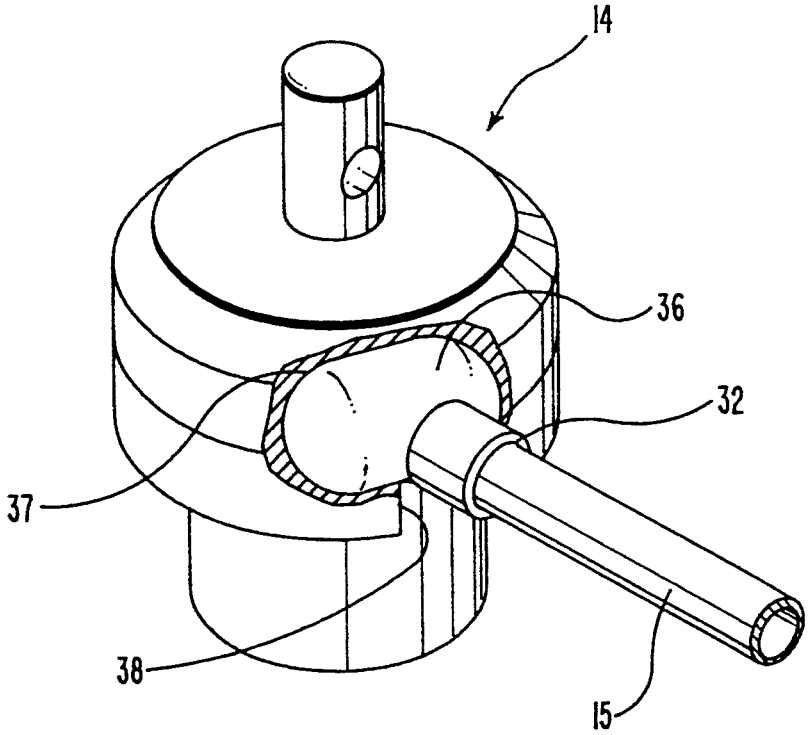
FIG. 4A is an expanded side elevation perspective sectional view taken within the line 4A—4A of FIG. 4, showing a cylindrical pivot secured across a tent pole end as a cylinder pivot coupling embodiment mounted in a crown seat, that is shown broken away.

A first embodiment of pivot coupling 16, as described above, is preferably a spherical ball 31 with shoulders 32 as shown best in FIGS. 3 and 3A. FIGS. 4 and 4A illustrate a second embodiment of a pivot coupling for pivotally coupling, respectively, the tent pole 15 ends to the crown 14 and rib 18 ends to the erecting ring 19. Which pivot coupling, as shown in FIG. 4A, preferably consists of a cylinder 36 whereto the rib 18 is mounted to a midpoint of the cylinder, the rib forming a ninety (90) degree angle to the longitudinal axis of which cylinder. Appropriately, the crown includes a seat 37 that is formed a half cylindrical sections in the upper and lower sections **14*a* and 14*b*, respectively, with a radial slot 38 formed from which cylindrical slot section to the crown outer surface. Which slot 38, in the lower section 14*b*, is formed through ninety (90) degrees of arc to allow the tent pole 15 to pivot from the attitude shown in FIGS. 1–4 to the attitude shown in FIG. 5. Like the above set out spherical pivot, the cylindrical pivot is preferably also utilized for pivot mounting 16 of the ribs 18 to the erecting ring 19. In erecting which tent poles 15 and ribs 18, the cylindrical pivot 36 turning in its seat 37 in crown 14 and erecting ring 19 prohibits canting of the tent pole or rib out of a straight vertical track along a crown and erecting ring radial as the tent frame 11** is erected. Of course, a combination of the spherical and cylindrical pivots in pairs or individually could be utilized as the tent pole and crown and rib and erecting ring pivotal mountings within the scope of this disclosure.

As set out above, the tent frame 11 is erected by sliding the respective crown 14 and erecting ring 19 together along the center pole 13 to where the opposing ends of upper and lower sleeves 20 and 21 engage. In which attitude the tent poles 15 will have been urged outwardly by outward travel of ribs 18 to a fully bowed attitude and that attitude maintained by the passage of the erecting ring 19 past the point where the ribs are horizontal to where the opposing upper and lower sleeve 20 and 21 ends engage. At which point the forces applied by the bowed tent poles 15 through the ribs 18 urge the erecting ring 19 and lower sleeve 21 upwardly prohibiting the ribs 18 from pivoting back to the horizontal, the upper and lower sleeve ends opposing surfaces urged together. Crown 14 and erecting ring 19 travel is guided by the center pole 13 that is fitted, in sliding engagement, axially through both the crown and erecting ring. In practice, the center pole 13 is held by an operator who grips a loop **40*a* that is shown as a section of a flexible material, such as a leather thong, that is threaded through a transverse hole formed through the center pole lower end and with their other hand lifts the erecting ring 19 towards the crown 14. So arranged, the erecting ring 19 slides along the center pole 13 to the attitude shown in FIGS. 1 and 2. To lower the erecting ring 19 away from the crown 14, the erecting ring is pulled downwardly along with center pole 13 that slides axially through crown 14, the erecting ring in engagement with the loop 40*a*, lowering the tent frame 11 to the attitude shown in FIG. 5. In which attitude the center pole will have slid through the crown 14 to where a top loop 40*b* engages or is near to the crown upper surface, prohibiting passage of the center pole therethrough, as shown in FIG. 5**.

A handle 41 is preferably provided for turning onto a threaded sleeve 42 that is turned through the erecting ring 19 for clamping against the undersurface of which erecting ring, sandwiching an apex 43 of the tent material 12 therebetween. Handle 41, shown best in FIG. 5, is for gripping by an operator who reaches within the tent material 12 for moving the erecting ring 19 along the center pole 13. That center pole sliding within a slide sleeve 44 that extends between which erecting ring and handle. Further for facilitating sliding of which center pole 13, a slide sleeve 45 is fitted axially in the crown 14 and upper sleeve 20, as shown best in FIG. 4.

Figure 8:
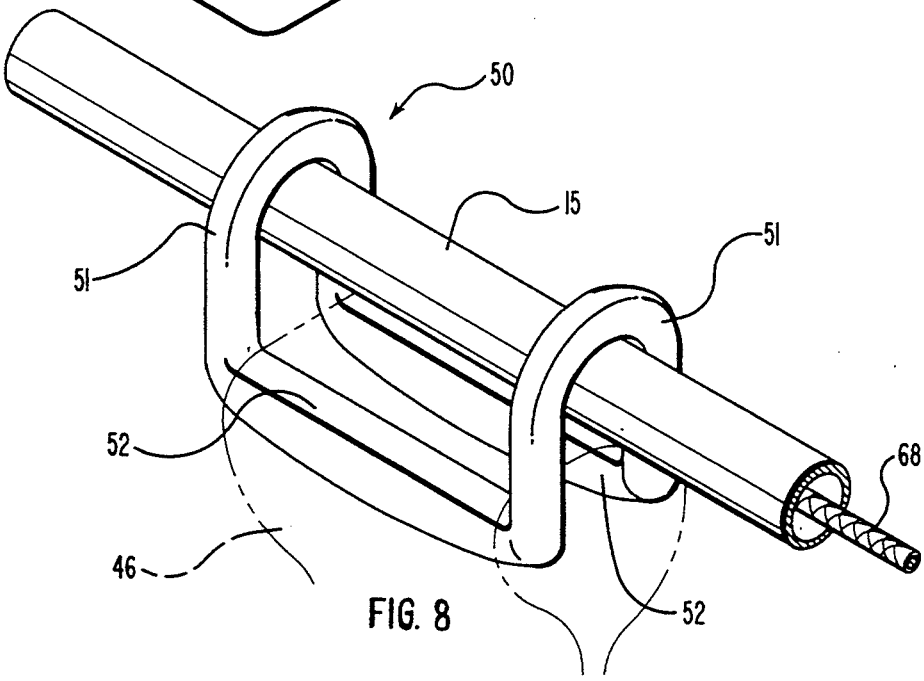
FIG. 8 is an expanded profile sectional view taken within the line 8—8 of FIG. 1, showing, as a slide embodiment, a double yoke slide with a tent pole fitted through the align yoke openings and showing bars mounted between which yoke end that are fitted through a tent covering material loop, shown in broken lines.
Figure 8A:
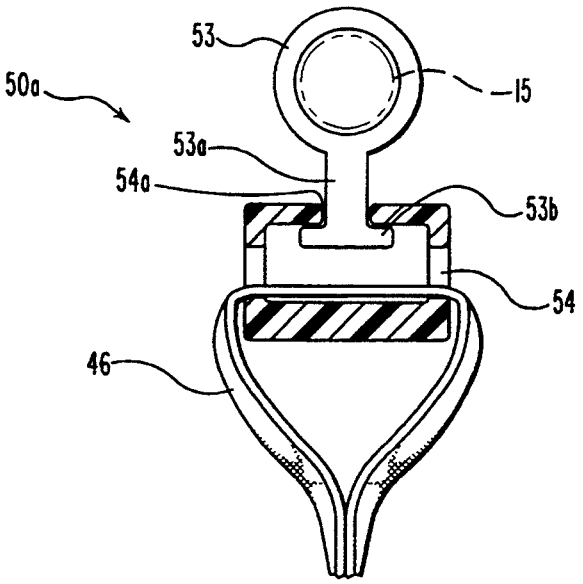
FIG. 8A is a view like FIG. 8 except it is of another slide embodiment that includes a circular ring wherethrough a tent pole is fitted which ring includes a key extension that is for fitting and turning in a slot of a rectangular ring wherethrough a tent covering material loop, shown in broken lines, in fitted.

Additional to the tent material 12 attachment to the erecting ring 19 at its apex 43, the tent material includes a number of pole loops 46 that are secured at space intervals vertically along the junction 47 of tent material panel sections. Shown in FIG. 1, a vertical column of pole loops 46 are immediately opposite to a tent pole 15 when the tent pole has been bowed outwardly, forming the erected tent frame 11. The pole loops 46 are supported to which tent poles 15 to stretch the tent material 12 between the erected frame tent poles. In which stretching the pole loops 46 need to slide freely along the tent poles for adjusting tent material positioning relative to the tent poles, prohibiting binding and possible tent material tearing. As pole loop 46 sliding mounts to the tent poles 15 the invention employs, as shown in FIGS. 8 and 8A, slides 50 and **50*a* that are formed as a single units. Slide 50 consists of a pair of U-shaped segments 51 with foot ends of each interconnected by parallel bars 52. The openings through which U-shaped segments align to receive a tent pole fitted in sliding arrangement therethrough, with the respective bars 52 fitted through the pole loops 46, mounting the slide 50 onto which pole loop 46. So arranged, the slide 50 will travel up or down along the tent pole as the tent frame 11** is erected or lowered.

FIG. 8A shows slide embodiment **50*a* as including a ring 53 that receives tent pole 15 fitted therethrough and includes a key 53*a* extending from the side thereof with oppositely extending tabs 53*b* protruding from the key lower end. The key for fitting into a slot 54*a* formed in a square ring 54 wherethrough the pole loop 46, shown in broken lines, is threaded. The key 53*a* 15 for turning within which slot 54*a* to move the tabs 53*b* beneath square ring 54 inner surface, adjacent to slot 54*a*. The tabs 53*b* therefore lock the ring 53 to the square ring 54, allowing the pole loop 46 to move along which tent pole 15 adjusting tent material 12 positioning as the tent frame 11** is erected or lowered.

Figure 9:
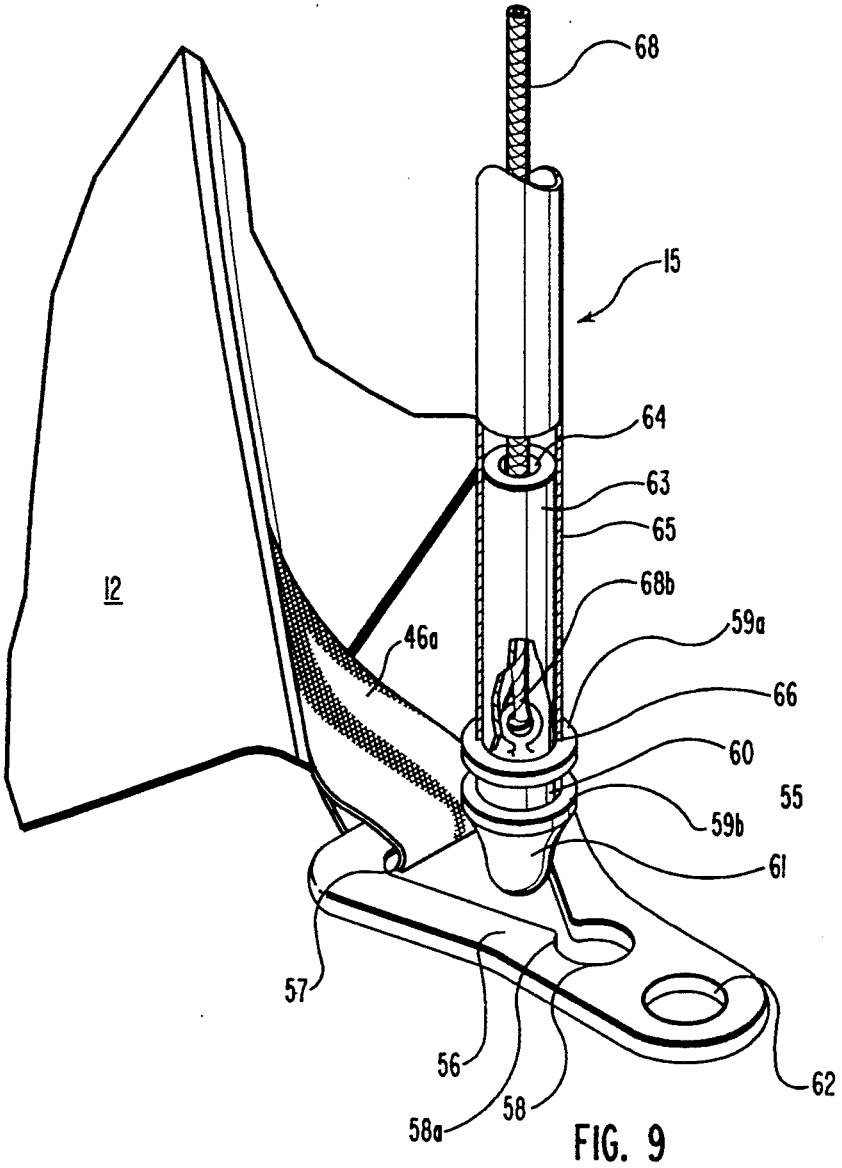
FIG. 9 is an expanded profile sectional view taken within the line 9—9 of FIG. 1, showing a loop from the tent bottom fitted to triangular shaped web strap that has a center triangle opening formed therethrough that received a foot end of a tent pole shown aligned for fitted in a round hole at the apex of which triangle opening.

To complete the integral arrangement of the tent frame 11 with the tent material 12, forming tent 10, as shown best in FIG. 9, the tent pole 15 lower end is fitted with a foot 55 that is for releasable coupling to a web strap 56 that is, in turn, connected to a lower or bottom pole loop **46*a*. The web strap 56 is a flat thin section of a somewhat flexible material, such as leather or plastic, and preferably has a triangular shape with a long apex. A triangular opening 57 is formed in the center area thereof with a round hole 58 formed at the apex of which triangular opening 57. Which round hole 58 is of a diameter to accommodate a section 60 of the foot 55 fitted therein that is arranged between upper and lower washers 59***a* and 59*b*, respectively. The foot 55 is fitted within the triangular opening 57 so as to align the foot section 60 with the round hole 58 and an operator, not shown, urges the foot section 60 through a necked in area 58*a* between the triangular opening 57 and round hole 58. The foot section 60 is thereby seated in which round hole 58, and is prohibited from sliding by the upper and lower washers 59*a* and 59*b* that prohibit up or down travel of the foot 55. When the foot 55 is seated within the web strap 56 round hole 58, as shown in FIG. 9, a pointed end 61 of which foot 55 will extend from the undersurface of which web strap 56 for engaging the ground. Additionally, the web strap 56 long apex section includes a hole 62 formed therethrough that is for receiving a tent stake, not shown, or the like, for maintaining the tent 10 to the ground.

The foot 55, for mounting into the female end 66 of a tent pole section 65, includes a mounting cylinder 63 that has a diameter that is appropriate for telescoping into a tent pole section female end 66 and is open longitudinally at 64 for receiving an elastic cord 68, known also as a bungee cord. Shown in the broken away portion of FIG. 9 the elastic cord 68 is threaded through mounting cylinder 63 longitudinal opening 64 and is secured, under tension, at 68*b* as by tying it through a loop in the foot 55 for maintaining tent pole sections 65 telescoped together and to the mounting cylinder 63, as set out below.

Figure 6A:
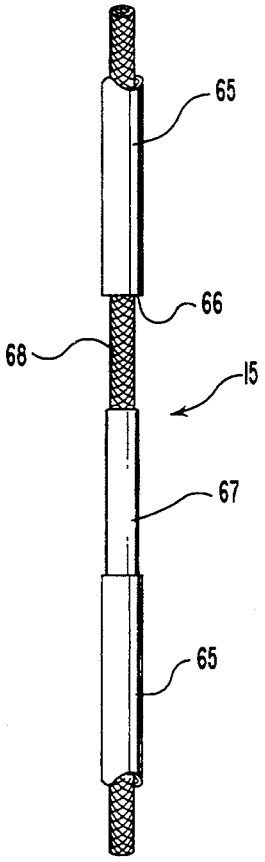
FIG. 6A is an expanded side elevation sectional view taken within the line 6A—6A of FIG. 5, showing male and female ends of like tent pole sections being pulled apart against a biasing of an elastic cord contained therein.
Figure 6B:
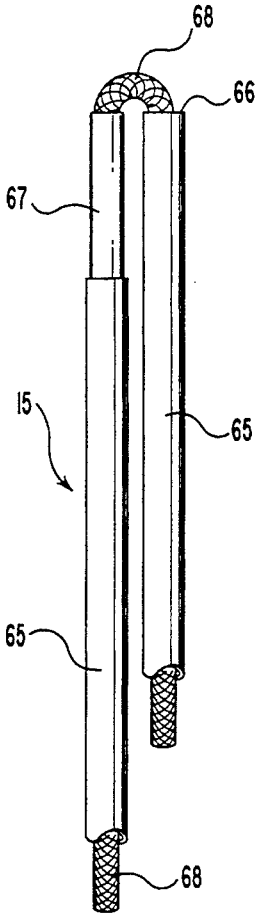
FIG. 6B is a view like that of FIG. 6A except that one pole section is shown bent around the pole section coupling end.

The tent poles 15 are shown in FIG. 5 in an unbent or flexed state, which tent pole is shown in FIG. 6A being broken down into sections for folding upon one another. Which folded attitude is shown in FIG. 6B. The tent pole sections 65 each include a female end 66 and a male end 67. The male end 67 is for fitting into the female end 66 when the ends are aligned and urged or drawn together. To provide for such coupling, the invention preferably employs the elastic cord 68 that is fitted through each tent pole section 65, and is maintained under tension as by tying the end in a knot 68*a* that is contained, as shown in a removed section FIG. 7, within the tent pole sleeve 30. The elastic cord 68 is maintained under tension within the tent pole sections 65, tending to pull which sections together along the length of tent pole 15. Accordingly, to take down or collapse the tent frame 11 of FIG. 5, an operator pulls apart the individual tent pole sections 65 as illustrated in FIG. 6A, stretching the elastic cord 68. The operator then folds the one tent pole section 65 on another, as shown in FIG. 6B, reducing the tent frame height to the length of the individual tent pole sections. The folded tent pole sections 65 can then be rolled into the tent material 12, forming a compact bundle for storage and transport.

To erect the tent frame 11 into the tent of FIG. 1, the folded tent pole sections 65, that are preferably formed of a light weight metal tube, such as aluminum, are separated from the tent material 12 that is preferably a canvas or plastic material, and are unfolded from one another. In the unfolding the tent pole sections female and male ends 66 and 67, respectively, are aligned with the elastic cords 68 that pull the sections together into tent poles 15. The tent poles are then spread apart with the tent material 12 centered between them, as shown in FIG. 5. Whereupon an operator reaches into the tent interior and lifts handle 41 to slide the erecting ring 19 upwardly along the center pole 13 to the attitude shown in FIGS. 1–4. Which erecting ring 19 travel toward the crown 14 extends ribs 18 outward that bow the tent poles 15 outwardly into the erected tent frame 11. In which tent frame 11 erection, the tent material 12 pole loops 46 and slides 50 or 50*a*, that are preferably formed of metal, such as aluminum, but may be of a plastic material, travel along the tent poles 12 adjusting the positioning of tent material as the tent poles are bowed outwardly, forming the erected tent 10. The erected tent can then be staked to the ground as by driving tent stakes, not shown through the holes 62 in each of the web strap 56 that can be formed of fabric, leather or plastic within the scope of this disclosure. The erected tent 10 can include a netting screen 12*a* arranged across an open the tent door area and across an area 12*b* around the tent apex, and which tent 10 preferably includes a flap 12*c* for unrolling to cover the tent door and a cover, not shown, for covering over the tent apex area netting screen 12*b*.

A preferred embodiment of my invention in an improved inverse umbrella tent and the component elements thereof has been shown and described herein. It should, however, be apparent that this disclosure is made by way of example only and that variations and modifications thereto are possible within the scope of this disclosure without departing from the subject matter coming within the scope of the following claims, and a reasonable equivalency thereof, which claims I regard as my invention.

I claim:

1. A collapsible shelter comprising, a sheet of material formed into cover; a frame that mounts said cover and, when erected, supports said cover, forming an enclosed shelter, said frame including a plurality of tent poles each capable of flexing to a bowed attitude and which are each connected on a top end by a pivotal coupling to a crown means that contains pivot seats spaced therearound that each receive a tent pole pivot means that is mounted to a top end of each of said tent poles, forming an apex of said frame, and said crown means is arranged to receive a center pole that is fixed axially to slide freely therethrough, which said center pole is also fitted axially, in sliding arrangement, through an erecting ring means that contains a plurality of pivot seats spaced therearound that each receive a first pivot means that is mounted to an end of one of a plurality of ribs, and each of said ribs has an opposite end that is mated by a second rib pivot means to one of said tent poles, each of which said tent pole pivot means and each said rib first pivot means mountings in said crown means and said erecting ring means seats prohibit side to side movement of each said tent pole and each said rib as they are extended outwardly along radials from said crown means and erecting ring means during tent frame erection; slide means for connection to individual loop means that extend at intervals from said sheet of material and are fitted to slide along one of said tent poles that each consist of a pair of parallel U-shaped segments having ends that are interconnected by identical straight parallel bars, with aligned openings through said U-shaped segments for receiving a tent pole fitted therethrough in sliding arrangement, and said parallel bars are for receiving a loop strap of the cover fitted therethrough; and a plurality of web strap means that individually extend at intervals from around a bottom edge of said cover, each for receiving and releasable connecting to a foot that is secured to a lower end of each said tent pole.

2. A collapsible shelter as recited in claim 1, wherein each tent pole pivot means and rib first pivot means is a sphere that is secured to an end of each tent pole and each rib, and each said tent pole pivot means and rib first pivot means sphere includes shoulders extending outwardly therefrom projecting from opposite sides of each said tent pole and rib, said shoulders having flat parallel outside surfaces; and the seats in the crown means and erecting ring means are spherical and each includes a radial opening that extends from said spherical seat to the crown means and erecting ring means outer surfaces, through approximately ninety (90) degrees downwardly and have flat parallel opposing surfaces for accommodating said shoulders flat parallel outside surfaces.

3. A collapsible shelter as recited in claim 1, wherein the center pole is straight and includes stop means secured at each of its ends for prohibiting travel of said center pole through the crown means and erecting ring means.

4. A collapsible shelter as recited in claim 1, further including sleeves that are secured to lower and upper surfaces of the crown means and erecting ring means respectively, and the center pole is fitted in sliding arrangement through each said sleeve; and a handle means is mounted to said erecting ring means lower surface that is open centrally to receive said center pole fitted therethrough and the sheet of material is secured at approximately its center, to said erecting ring means lower surface.

5. A collapsible shelter as recited in claim 1, wherein the second rib pivot means for coupling an end of each rib to each tent pole is a clevis that is secured to an end of each said rib that includes a pair of parallel plates that extend from said rib end that each have a transverse hole formed therethrough that align, and a disk for fitting between said parallel plates is secured to extend from an intermediate point along each said tent pole longitudinal axis, said disk is for fitting between said parallel plates and each said disk includes a pair of pivots that extend oppositely at right angles outwardly from said disk opposite faces for fitting through the parallel plates transverse holes.

6. A collapsible shelter as recited in claim 1, wherein the web strap means is a triangular shaped section that includes a long apex with a triangle section removed from the center thereof and includes a round hole as a triangle apex, said triangular shaped section having a base that receives a section of cloth material that is looped through said triangle section and is connected at its end to the cover; and a foot of each tent pole includes a pointed end adjacent to an inset area that is formed between parallel shoulders that is for fitting into said triangle section to where said inset area slides into said triangle section apex round hole, said foot inset area for fitting into said round hole, with opposing surfaces of said parallel shoulders engaging the surfaces of said web strap means around said round hole.

7. A collapsible shelter as recited in claim 6, wherein the web strap means triangular shaped section includes a round tent peg hole formed through its long apex.

8. A collapsible shelter as recited in claim 1, wherein the tent poles are each formed from interconnected tubular tent pole sections, each said tent pole section is straight and has opposite male and female coupling ends, said male coupling end for telescoping in another tent pole section female coupling end; and an elastic cord is fitted through said tent pole section and maintained under tension to maintain the interconnected tent pole sections together as a said tent pole.

9. A collapsible shelter as recited in claim 8, wherein each elastic cord has an end that is maintained in each tent pole at its foot end and in a tent pole sleeve that is at the junction of each of the ribs and tent poles.

10. A collapsible shelter as recited in claim 1, wherein the cover is formed from separate sheets of material that are connected together, as by sewing, to cover the frame with the respective loop means and strap means fitted at intervals to the seams or junctions of the separate sheets of material.

11. A collapsible shelter comprising, a sheet of material formed into cover; a frame that mounts said cover and, when erected, supports said cover, forming an enclosed shelter, said frame including a plurality of tent poles each capable of flexing to a bowed attitude and which are each connected on a top end by a pivotal coupling to a crown means that contains pivot seats spaced therearound that each receive a tent pole pivot means that is mounted to a top end of each said tent pole, forming an apex of said frame, and said crown means is arranged to receive a center pole that is fitted axially to slide freely therethrough, which center pole is also fitted axially, in sliding arrangement, through an erecting ring means that contains a plurality of pivot seats spaced therearound that each receive a first pivot means that is mounted to an end of one of a plurality of ribs, and each of said ribs has an opposite end that is mated by a second rib pivot means to one of said tent pole pivot means, each of which said tent pole pivot means and each said rib first pivot means mountings in said crown means and said erecting ring means seats prohibit side to side movement of each said tent pole and said rib as they are extended outwardly along radials from said crown means and erecting ring means during tent frame erection; slide means for connection to individual loop means that extend at intervals from said sheet of material and are fitted to slide along said tent poles; and a plurality of web strap means that individually extend at intervals from around a bottom edge of said cover, each for receiving and releasable connecting to a foot that is secured to a lower end of each said tent pole and each is a triangular shaped section that includes a long apex with a triangle section removed from the center thereof and includes a round hole as a triangle apex, said triangular shaped section having a base that receives a section of cloth material that is looped through said triangle section and is connected at its ends to the cover; and a foot of each tent pole includes a pointed end adjacent to an inset area that is formed between parallel shoulders that is for fitting into said triangle section to where said inset area slides into said triangle section apex round hole, said foot inset area for fitting into said round hole, with opposing surfaces of said parallel shoulders engaging the surfaces of said web strap means around said round hole.

12. A collapsible shelter as recited in claim 11, wherein each tent pole pivot means and rib first pivot means is a sphere that is secured to an end of each tent pole and each rib, and includes shoulders extending outwardly therefrom projecting from opposite sides of each said tent pole and rib, said shoulders having flat parallel outside surfaces; and the seats in the crown means and erecting ring means are spherical and each includes a radial opening that extends from said spherical seat to the crown means and erecting ring means outer surfaces, though approximately ninety (90) degrees downwardly and have flat parallel opposing surfaces for accommodating said shoulders flat parallel outside surfaces.

13. A collapsible shelter as recited in claim 11, wherein the center pole is straight and includes stop means secured at each of its ends for prohibiting travel of said center pole through the crown means and erecting ring means.

14. A collapsible shelter as recited in claim 11, further including sleeves that are secured to lower and upper surfaces of the crown means and erecting ring means respectively, and the center pole is fitted in sliding arrangement through each said sleeve; and a handle means is mounted to said erecting ring means lower surface that is open centrally to receive said center pole fitted therethrough and the sheet of material is secured, at approximately its center, to said erecting ring means lower surface.

15. A collapsible shelter as recited in claim 11, wherein the second rib pivot means for coupling an end of each rib to each tent pole is a clevis that is secured to an end of each said rib that includes a pair of parallel plates that extend from said rib end that each have a transverse hole formed therethrough that align, and a disk for fitting between said parallel plates is secured to extend from an intermediate point along each said tent pole longitudinal axis, said disk for fitting between said parallel plates and each said disk includes a pair of pivots that extend oppositely at right angles outwardly from said disk opposite faces for fitting through the parallel plates transverse holes.

16. A collapsible shelter as recited in claim 11, wherein each slide means consists of a pair of parallel U-shaped segments having ends that are interconnected by identical straight parallel bars, with aligned openings through said U-shaped segments for receiving a tent pole fitted therethrough in sliding arrangement, and said parallel bars are for receiving a loop strap of the cover fitted therethrough.

17. A collapsible shelter as recited in claim 11, wherein the slide means each consist of a first ring that is open and is for receiving a tent pole fitted therethrough and includes a key means that extends from an outer edge of said first ring, said key means for fitting into and turning for locking in a slot that is formed in a second ring, said second ring for receiving a loop strap of the cover fitted therethrough.

18. A collapsible shelter as recited in claim 11, wherein the web strap means triangular shaped section includes a round tent peg hole formed through its long apex.

19. A collapsible shelter as recited in claim 11, wherein the tent poles are each formed from interconnected tubular tent pole sections, each said tent pole section is straight and has opposite male and female coupling ends, said male coupling end for telescoping in another tent pole section female coupling end; and an elastic cord is fitted through said tent pole sections and maintained under tension to maintain the interconnected tent pole sections together as a said tent pole.

20. A collapsible shelter as recited in claim 19, wherein each elastic cord has an end that is maintained in each tent pole at its foot end and in a tent pole sleeve that is at the junction of each of the rib and tent poles.

21. A collapsible shelter as recited in claim 11, wherein the cover is formed from separate sheets of material that are connected together, as by sewing, to cover the frame with the respective loop means and strap means fitted at intervals to the seams or junctions of the separate sheets of material.

* * * * *